US009981822B2

(12) United States Patent
Barnes

(10) Patent No.: US 9,981,822 B2
(45) **Date of Patent: *May 29, 2018**

(54) FLEXIBLE TUBE CLEANING LANCE DRIVE APPARATUS

(71) Applicant: STONEAGE, INC., Durango, CO (US)

(72) Inventor: Jeffery R. Barnes, Ignacio, CO (US)

(73) Assignee: Stoneage, Inc., Durango, CO (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/459,327

(22) Filed: Mar. 15, 2017

(65) Prior Publication Data

US 2017/0183193 A1 Jun. 29, 2017

Related U.S. Application Data

(63) Continuation of application No. 14/693,259, filed on Apr. 22, 2015, now Pat. No. 9,630,801.

(Continued)

(51) Int. Cl.
*B65H 51/10* (2006.01)
*B08B 9/043* (2006.01)

(Continued)

(52) U.S. Cl.
CPC ..... *B65H 51/10* (2013.01); *B08B 9/0433* (2013.01); *F28G 1/163* (2013.01); *F28G 15/04* (2013.01);

(Continued)

(58) Field of Classification Search
CPC ..... B65H 2402/60; B65H 2402/61; B65H 2402/62; B65H 2402/63; B65H 2402/631; B65H 2402/64; B65H 51/04; B65H 51/10; B65H 2402/512; B65H 2402/5121; B65H 2402/5122; B65H 2402/515; B65H 2402/5156; B65H 2402/45;

(Continued)

(56) References Cited

U.S. PATENT DOCUMENTS 3,459,354 A 8/1969 Land et al.
4,266,709 A 5/1981 Krüger (Continued)

FOREIGN PATENT DOCUMENTS

DE 3148225 6/1983
DE 19819406 11/1999

(Continued)

*Primary Examiner* — Michael C McCullough
(74) *Attorney, Agent, or Firm* — Greenberg Traurig, LLP

(57) ABSTRACT

A flexible lance drive device is disclosed that has, in a compact housing, a drive motor between an inner and an outer wall, a linear array of pairs of driven upper and lower drive rollers outside the outer wall coupled to the drive motor via shafts extending through both of the inner and outer walls. Each driven roller is fastened to its shaft via a quick release device. A drive sprocket is fastened to each shaft outside the inner wall. The drive motor is coupled to each of the drive sprockets via a serpentine belt carried outside the inner wall. The lower driven rollers are rotatably carried by the inner and outer walls. The upper driven rollers are rotatably carried by a block positioned between the inner and outer walls and coupled to the lower driven rollers by a pair of parallel links releasably biased by a piston driven linkage.

14 Claims, 9 Drawing Sheets

Related U.S. Application Data

(60) Provisional application No. 62/028,756, filed on Jul. 24, 2014.

(51) Int. Cl.

| | |
|---|---|
| ***F28G 15/04*** | (2006.01) |
| ***F28G 1/16*** | (2006.01) |
| *F28G 3/16* | (2006.01) |
| *F28G 15/02* | (2006.01) |

(52) U.S. Cl.
CPC ..... *B65H 2402/60* (2013.01); *B65H 2402/61* (2013.01); *B65H 2402/63* (2013.01); *B65H 2404/1521* (2013.01); *B65H 2404/1544* (2013.01); *B65H 2701/33* (2013.01); *F28G 3/163* (2013.01); *F28G 15/02* (2013.01)

(58) Field of Classification Search
CPC ..... B65H 2402/44; B65H 2405/453; B65H 2404/144; Y10T 403/70211; Y10T 403/7022; Y10T 403/7024; Y10T 403/592; F16B 3/04; F16B 17/004; F16B 17/006
See application file for complete search history.

(56) References Cited

U.S. PATENT DOCUMENTS

| | | | |
|---|---|---|---|
| 4,363,562 | A | 12/1982 | Hora |
| 4,445,668 | A | 5/1984 | Sauber |
| 4,743,175 | A | 5/1988 | Gilmore |
| 4,844,021 | A | 7/1989 | Stoss |
| 4,944,465 | A | 7/1990 | Levine |
| 5,002,120 | A | 3/1991 | Boisture et al. |
| 5,320,072 | A | 6/1994 | Theiss et al. |
| 5,782,255 | A | 7/1998 | Magnin et al. |
| 6,192,904 | B1 | 2/2001 | Secknus et al. |
| 6,390,389 | B1 | 5/2002 | Tudor |
| 6,557,742 | B1 | 5/2003 | Bobeczko |
| 6,557,850 | B1 | 5/2003 | Kallin |
| 8,048,234 | B2 | 11/2011 | Jacquinet |
| 8,568,046 | B2 | 10/2013 | Campbell |
| 9,074,830 | B2 | 7/2015 | Moll |
| 9,630,801 | B2 * | 4/2017 | Barnes ..... B08B 9/0433 |
| 2009/0211612 | A1 | 8/2009 | Athanassiu et al. |
| 2011/0155174 | A1 | 6/2011 | Moll et al. |

FOREIGN PATENT DOCUMENTS

| | | |
|---|---|---|
| GB | 1027717 | 4/1966 |
| GB | 2037392 | 7/1980 |
| GB | 2179637 | 3/1987 |
| GB | 230076 | 6/1998 |
| WO | WO96/17695 | 6/1996 |
| WO | WO02/059538 | 8/2002 |
| WO | WO02/068134 | 9/2002 |
| WO | WO2005/003611 | 1/2005 |
| WO | WO2005/054770 | 6/2005 |
| WO | WO2006/021164 | 3/2006 |
| WO | WO2009/088484 | 7/2009 |

* cited by examiner

FLEXIBLE TUBE CLEANING LANCE DRIVE APPARATUS

CROSS REFERENCE TO RELATED APPLICATIONS

This application is a continuation of U.S. patent application Ser. No. 14/693,259 filed Apr. 22, 2015, entitled Flexible Tube cleaning Lance Drive Apparatus which claims the benefit of U.S. Provisional Patent Application No. 62/028,756, filed Jul. 24, 2014, entitled Flexible Tube Cleaning Lance Drive Apparatus Having A Quick Change Roller Device.

BACKGROUND OF THE DISCLOSURE

The present disclosure is directed to high pressure fluid rotary nozzle handling systems. In particular, embodiments of the present disclosure are directed to an apparatus for advancing and retracting one or more flexible tube cleaning lances from tubes arranged in an array, such as in a heat exchanger, from a position adjacent a heat exchanger tube sheet.

A flexible lance drive apparatus typically includes a drive motor coupled via gearing, a chain, or a belt to one or more drive mechanisms. Drive mechanisms can be rollers that are arranged in pairs or sets sandwiching a flexible lance hose therebetween or chain and block assemblies oriented with interlocking top and bottom assemblies. At least one roller of the sets of rollers, or chain and block assemblies may be driven. In order to accommodate different diameter lance hoses, the rollers or chain and block assemblies must be laboriously disassembled and replaced, and it may be necessary to modify the drive motor as well to accommodate the characteristics of a different driven lance hose. Additionally, once a mechanism has been properly configured for a given lance hose size, the distance between opposing drive mechanism roller pairs as the force that a given pair exerts on a lance hose is typically adjusted via a manual mechanical adjustment. A drive apparatus such as is described in U. S. Patent Application publication No. 2011/0155174 requires the lance itself to be bent around a portion of the drive wheel in order to ensure sufficient drive force is transferred to the lance itself, especially in real world environmental application scenarios which are often less than ideal. Furthermore, such drive apparatuses are large, bulky, and thus must be either separately located on a floor near the heat exchanger tube sheet into which the lance or lances are supposed to be guided, as is shown in that publication, or rigidly mounted to a tray spaced from and aligned with the tube sheet. In such cases the tube bundle must be physically removed from the heat exchanger and placed in an environment with sufficient space to accommodate the tray and drive assembly. What is therefore needed is a compact package drive solution that takes up a minimal space, can be mounted directly to an x-y lance positioner, facilitates simplified handling of several different sized flexible lance hoses interchangeably, can operate consistently under a variety of operating conditions, can be optimized for performance remotely, and remains simple to repair, service and modify for a variety of applications.

SUMMARY OF THE DISCLOSURE

A flexible lance drive apparatus or device in accordance with the present disclosure directly addresses such needs.

One exemplary flexible lance drive device in accordance with the present disclosure includes a drive motor contained within a housing along with an array of pairs of driven rollers coupled to the drive motor via drive axle shafts wherein at least one driven roller of each pair of rollers is fastened to its axle shaft via a quick release device incorporated into the axle shaft upon which the driven roller is mounted.

One embodiment of a flexible lance drive apparatus in accordance with the present disclosure includes a hollow housing, a drive motor disposed in the housing operably engaging a plurality of drive axles arranged in a linear array of parallel axle pairs in the housing, each pair of drive axles supporting a pair of drive rollers engaged with one or more flexible lances held between the rollers. At least one of the drive axles has an axially extending closed slot adjacent the distal end of the at least one axle, a ball nosed spring plunger disposed in a cross bore through the distal end of the at least one axle, a spline disposed in the closed slot, and a drive roller releasably carried on the axle. The spline engages the axial slot along the roller bore and a ball nose of the spring plunger extends radially outward from the cross bore to retain the drive roller on the axle.

The axle is a cylindrical shaft having an axial slot carrying an axial spline spaced from one end of the shaft. The roller is a generally cylindrical sleeve having an outer portion and a central bore sized to fit onto the axle shaft. This central bore includes a keyway to accommodate the axial spline carried on the axle shaft. A cross bore through the axle shaft adjacent a distal end of the shaft holds a ball nosed spring plunger. The ball projecting beyond the surface of the axle shaft prevents removal of the roller from its axle shaft. The ball can be depressed by a user to facilitate withdrawal of the roller from the axle shaft without the use of any tools.

Each pair of driven rollers coupled to the drive motor via drive axle shafts and a serpentine belt can be adjusted remotely from a control panel such that the distance between rollers may be increased or decreased to accommodate a range of flexible lance (hose) sizes. The drive mechanism incorporates an air piston to accomplish this adjustment and also provides a capability to vary the clamp force that each pair of rollers exerts on a driven flexible lance. This permits remote adjustment of the drive characteristics to overcome reduced friction between the drive rollers and the lance caused by fluid or other contaminants becoming present on the flexible lance hose and rollers during use.

An exemplary embodiment of a flexible lance drive apparatus in accordance with the present disclosure preferably includes a hollow housing divided into a left section, middle section and a right section by a pair of spaced vertical walls. The hollow housing has an outer left side that may be hinged or otherwise opened like a door to permit access to the left section, a drive motor disposed in the mid section of the housing operably engaging a plurality of drive axles arranged in an array of parallel axle pairs wherein each axle is bearing supported by and passes through the pair of spaced vertical walls. Each drive axle has a pulley wheel fastened to an end of the axle extending into the left section of the housing. Each pair of drive axles supports a pair of drive rollers disposed in the right section of the hollow housing.

The housing also has an outer right side that may be hinged or otherwise opened like a door to permit access into the right section of the housing. Each pair of drive rollers in the right section of the housing is configured to engage one or more flexible lances that pass through the right section of the housing and which is/are held between each roller pair in the array of roller pairs. At least one of the drive axles has an axially extending closed slot adjacent the distal end of the at least one axle, a ball nosed spring plunger disposed in a cross bore through the distal end of the at least one axle, a spline disposed in the closed slot, and a drive roller releasably carried on the axle. The spline engages the axial slot along the roller bore and a ball nose of the spring plunger extends radially outward from the cross bore to retain the drive roller on the axle.

An embodiment of a flexible lance drive apparatus includes a generally rectangular housing having an outer section, an inner section and a mid section defined between a pair of spaced outer and inner walls, wherein the outer section of the housing is accessible via an outer door and the inner section is accessible via an inner door. An array of upper and lower drive rollers is contained within the outer section each rotatably supported by an axle shaft passing through the spaced outer and inner walls. A drive motor is disposed within the mid section and a drive sprocket is fastened to each of the shafts in the inner section of the housing. Each lower drive roller shaft is rotatably supported in a fixed position in each of the outer and inner walls and each of the upper shafts is rotatably supported by a block carried in the mid section of the housing by parallel pivoting link members fastened to the outer and inner walls adjacent the lower drive roller shafts.

An exemplary embodiment of the apparatus at least has two and may include three or more pairs of upper and lower drive rollers each configured to receive and hold therebetween a plurality of flexible lances. The upper shafts may each be disposed in slots in the inner and outer walls and rotatably fastened to an elongated block pivotally supported by a pneumatic cylinder fastened to the housing. In such an embodiment the upper shafts are connected to the inner and outer walls via pivoting links. At least two pairs of pivoting links may be used to connect the elongated block to the inner and outer walls adjacent the lower drive roller shafts. A serpentine belt in the inner section of the housing is preferably connected between each of the drive sprockets and the drive motor and is operable to synchronously rotate the rollers.

At least one of the roller axle shafts preferably has an axially extending closed slot adjacent a distal end of the axle, a ball nosed spring plunger disposed in a cross bore through the distal end of the axle, a spline disposed in the closed slot, and a drive roller having a central bore and an axial slot along the bore. When the roller is assembled onto the axle, the spline engages the axial slot along the roller bore and a ball nose of the spring plunger extends radially outward from the cross bore to retain the drive roller on the axle.

Preferably an embodiment may include a roller carried on a distal end of each of the drive axles, wherein at least one of the drive axles has an axially extending closed slot adjacent the distal end of the at least one axle, a ball nosed spring plunger disposed in a cross bore through the distal end of the at least one axle, a spline disposed in the closed slot, and a drive roller releasably carried on the at least one axle and wherein the spline engages the axial slot along the roller bore and a ball nose of the spring plunger extends radially outward from the cross bore to releasably retain the drive roller on the axle.

An embodiment of a flexible lance drive apparatus in accordance with the present disclosure may include a generally rectangular housing having an outer section, an inner section and a mid section defined between a pair of spaced outer and inner walls, an array of upper and lower drive roller pairs in the outer section each rotatably supported by an axle shaft passing through the spaced outer and inner walls, and a pneumatic drive motor within the mid section having a drive sprocket extending into the inner section. A drive sprocket is fastened to each of the shafts in the inner section of the housing and connected to the drive motor via a serpentine belt. Each lower drive roller shaft is rotatably supported in a fixed position in each of the outer and inner walls; and each of the upper shafts is rotatably supported by a block carried in the mid section of the housing by parallel pivoting link members fastened to the outer and inner walls adjacent the lower drive roller shafts.

In an embodiment, the upper shafts are each disposed in slots in the inner and outer walls and rotatably fastened to the block pivotally supported by a pneumatic cylinder fastened to the housing. In such an embodiment the upper shafts are connected to the inner and outer walls via pivoting links. At least two pairs of pivoting links preferably connect the elongated block to the inner and outer walls adjacent the lower drive roller shafts. At least one idler wheel having an adjustable span preferably contacts the serpentine belt in the inner section of the housing connected between each of the drive sprockets and the drive motor. The span position of the idler wheel can be used for maintaining and adjusting tension on the serpentine belt.

Further features, advantages and characteristics of the embodiments of this disclosure will be apparent from reading the following detailed description when taken in conjunction with the drawing figures.

DETAILED DESCRIPTION

Figure 1:
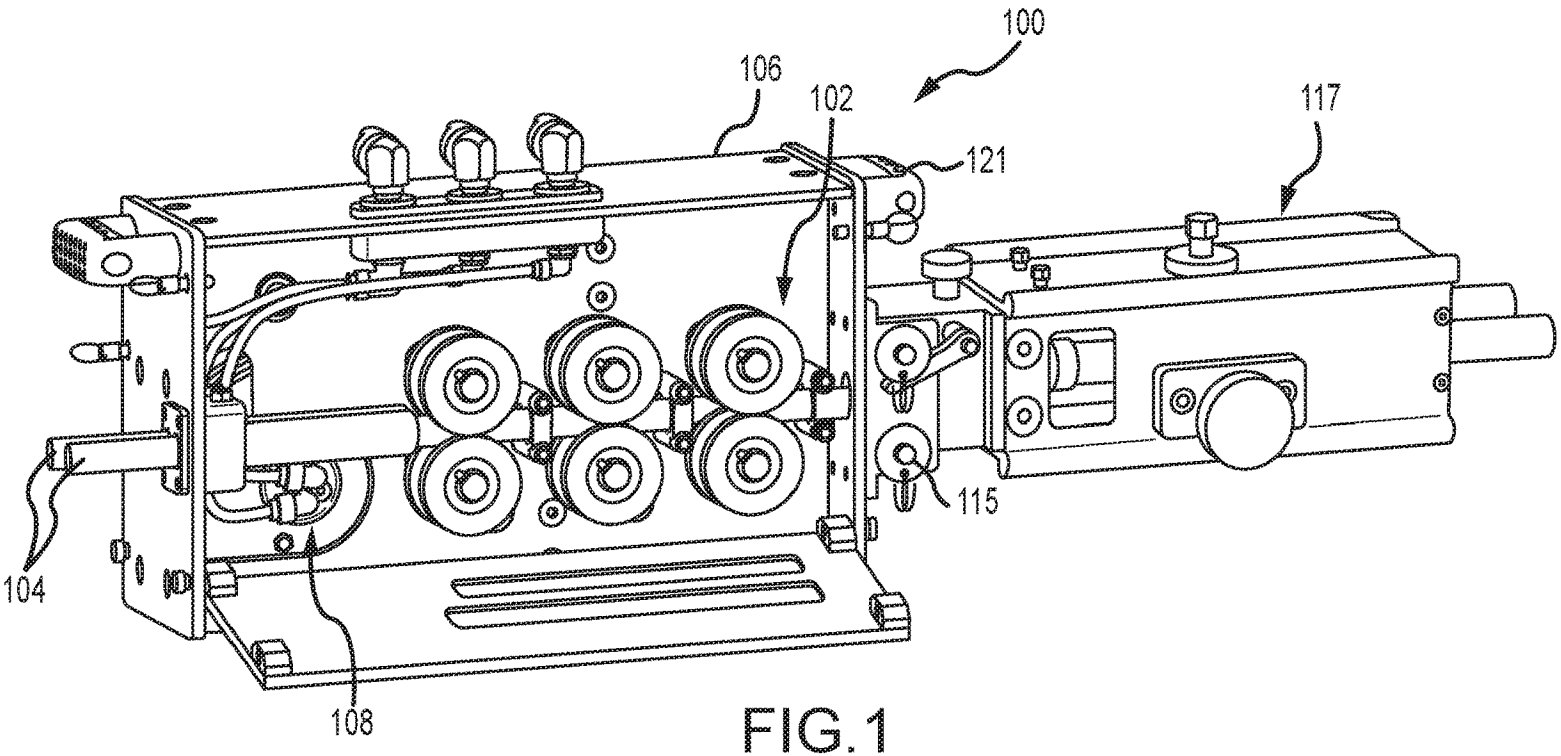
FIG. 1 is a perspective view of a first exemplary embodiment of a flexible lance drive mounted on a positioner frame apparatus in accordance with the present disclosure oriented against and fastened to an exemplary heat exchanger tube sheet.

An exemplary drive apparatus 100 is shown in FIG. 1 with a side cover open showing the set of 3 pairs of drive rollers 102 arranged for driving two flexible lances 104 in accordance with one embodiment of the present disclosure. The apparatus 100 includes a housing 106 in which a drive motor 108 drives each of the six drive rollers 102.

Figure 2:
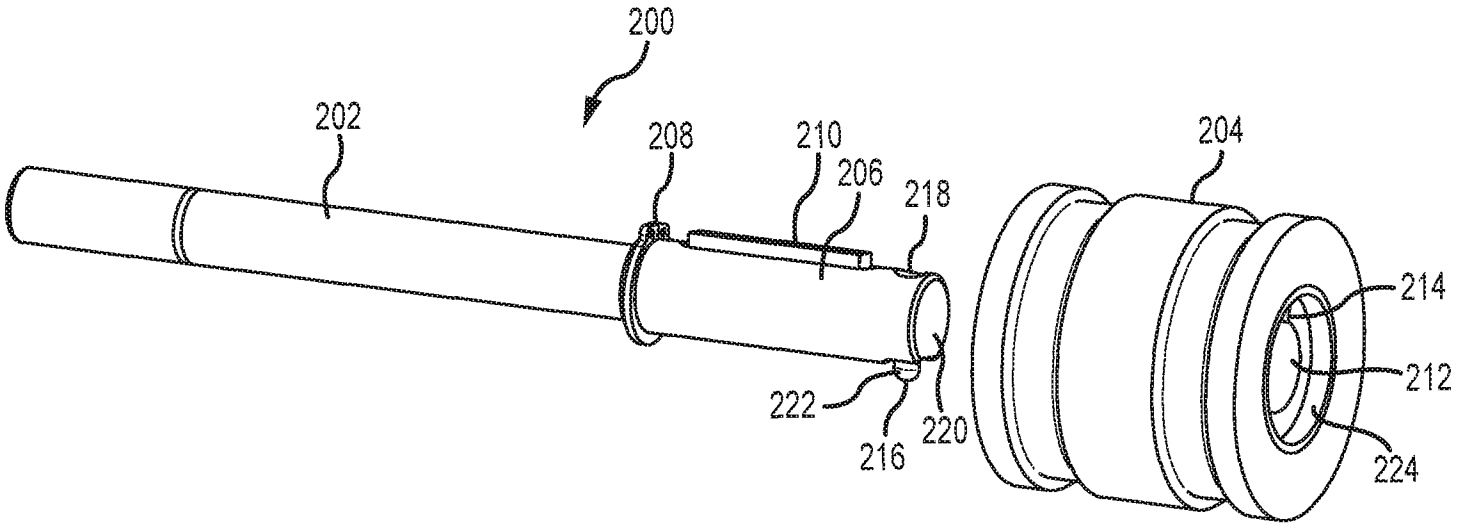
FIG. 2 is a separate exploded perspective view of an axle and a roller in accordance with the present disclosure.

A quick change drive shaft and roller assembly 200 for use in the apparatus 100 is shown in an exploded perspective view in FIG. 2. The assembly 200 has a cylindrical axle 202 and a roller wheel 204. The axle 202 has an axially extending slot 206 extending along and spaced from a distal end of the axle 202. A snap ring 208 in a peripheral groove around the axle 202 limits how far the roller 204 can slide along the axle 202. The roller 204 has an axial bore 212 therethrough sized to slip over the axle 202. This bore 212 also has an axially extending slot 214 such that when the roller 204 is installed on the axle 202 so as to abut the snap ring 208, a spline 210 in the slot 206 prevents rotation of the roller 204 on the axle 202. A ball nosed spring plunger 216 is captured in a cross bore 218 adjacent the distal end 220 of the axle shaft 202. This ball nosed spring plunger 216 pushes a ball 222 resiliently outward of the plunger 216 so as to engage a recess 224 around the bore 212 through the roller 204 so as to retain the roller 204 on the shaft 202 without the need for a threaded end on the axle to accommodate a nut or other fastener. A user can simply depress the ball 222 and pull the roller 204 off of the shaft 202 and exchange the roller 204 for one of a different size.

Figure 3:
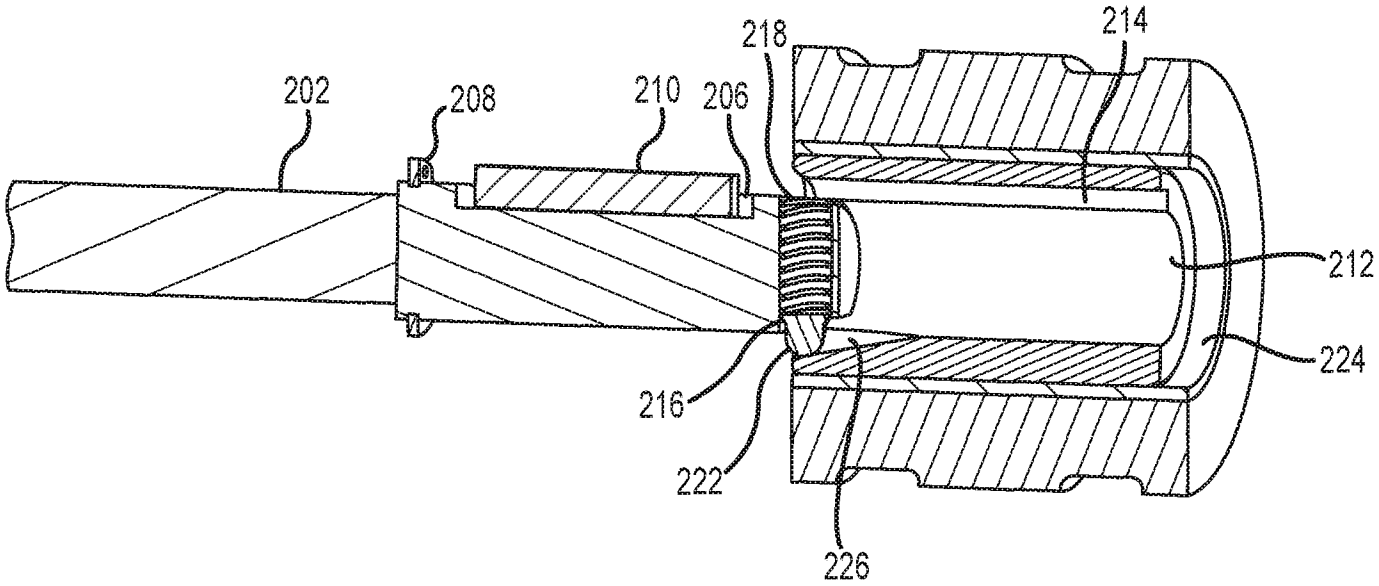
FIG. 3 is a longitudinal sectional view of a roller being installed on an axle shown in FIG. 2.
Figure 4:
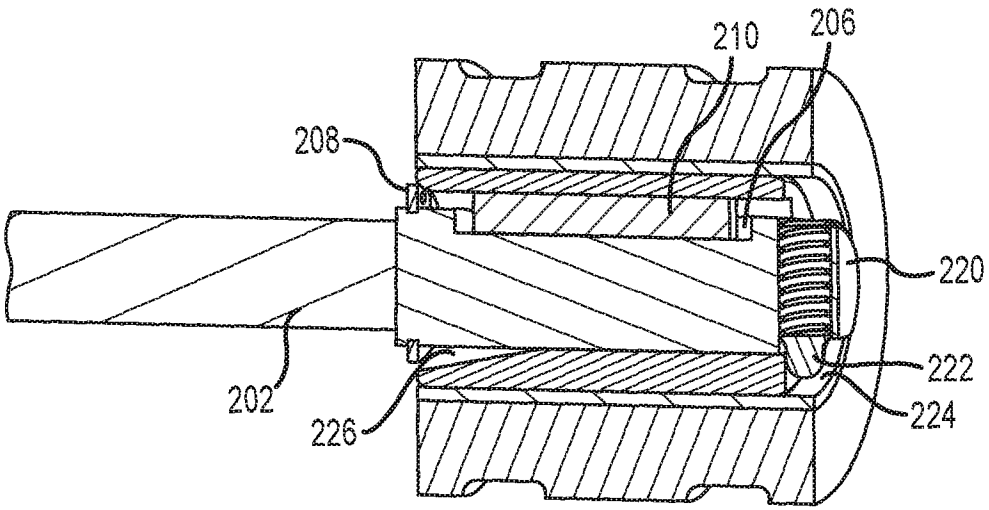
FIG. 4 is an enlarged longitudinal sectional view of the installed roller shown in FIG. 3.

A longitudinal sectional view through the axle 202 and roller 204 is shown in FIG. 3. The bore 212 through the roller 204 has an inclined axial recess or groove 226 opposite the axially extending slot 214 extending from its inner end. During roller installation, the roller 204 is oriented such that the ball 222 engages the inclined recess 226. This ensures that the spline 210 is aligned with the slot 214. The roller 204 is then pushed onto the axle 202, depressing the ball 222 within the plunger 216, and guided to the retaining snap ring 208 via the spline 210. When the roller 204 abuts the retaining ring 208, the ball 222 snaps outward into the recess 224, thus securely holding the roller on the axle 202. The fully installed roller 204 on the axle 202 is shown in an axial sectional view in FIG. 4.

Figure 5:
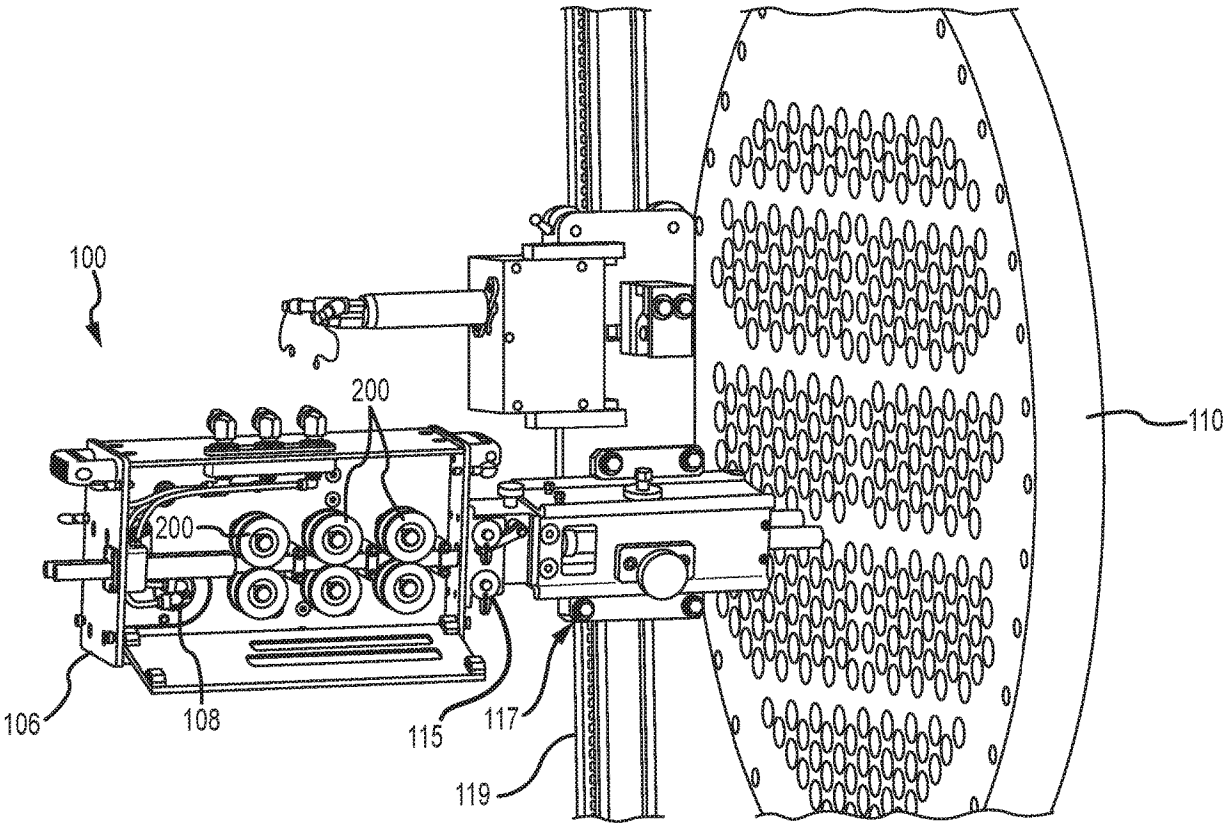
FIG. 5 is a perspective right, or outer side view of the flexible lance drive apparatus with the right side door open, in accordance with the present disclosure, supported adjacent a heat exchanger tube sheet.

FIG. 5 shows a drive apparatus 100 supported for guiding one or more flexible lance hoses 104 (shown in FIG. 1) into and out of a tube in a tube sheet 110. The drive apparatus 100 has six driven quick release roller assemblies 200, described in detail above, aligned in a two by three linear array. This same drive apparatus 100 is shown in a separate enlarged side view in FIG. 6 ready for removal and insertion of the quick release rollers. The drive apparatus 100 has three upper quick release drive roller assemblies 200 and three lower quick release drive roller assemblies 200 arranged in a fixed horizontal line within the housing 106. Thus the three lower drive assemblies 200 are mounted on axles 202 supported in fixed positions in the inner and outer walls 112 and 114 in the housing 106. In contrast, the upper drive roller assemblies are not supported by the inner and outer walls 112 and 114. Instead, these drive roller assemblies 200 pass through slots 116 in the walls 112 and 114 and are rotatably supported by the upper drive roller support block 300 as is more fully described below.

The drive apparatus 100 has two vertically aligned partition walls within the housing 106. These are inner wall 112 and outer wall 114 which divide the internal space within the housing 106 into three sections or cavities. The outer section or cavity houses the drive rollers 102 and flexible lance hoses 104, which are visible in FIGS. 1, 5, and 6. The inner section or cavity adjacent inner wall 112 houses the drive belt and drive sprockets and idler sprockets and is visible in FIG. 7. The mid section or center cavity contains the pneumatic drive motor 108, a pivoting pneumatic cylinder 312 that has one end connected to an upper drive roller support block 300, and parallel link members 302 and 304. This internal mid section structure of the drive apparatus 100 is visible in FIGS. 8 and 9 with the outer partition wall 114 behind the rollers shown as being transparent so that the internal structures within the mid section are visible.

Figure 8:
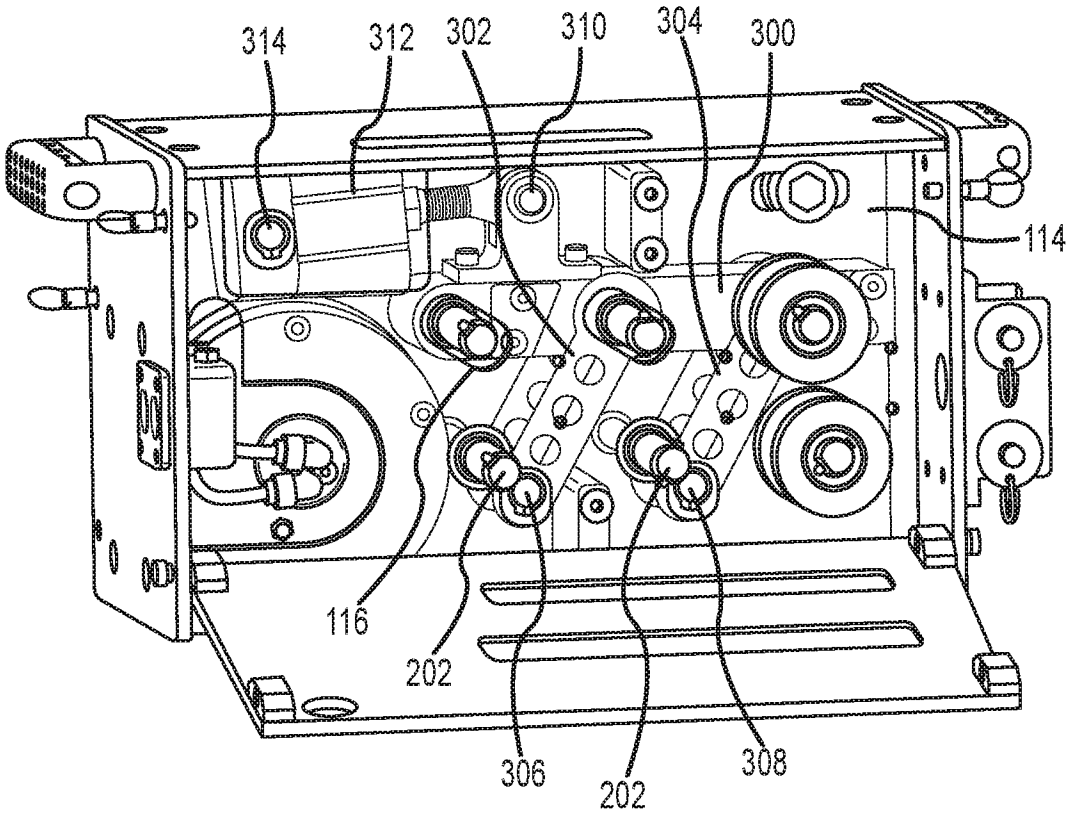
FIG. 8 is a perspective view as in FIG. 6 with the outer right side partition plate or wall shown transparent in order to reveal the roller clamping structure located in the mid section of the housing in a hose release position.
Figure 9:
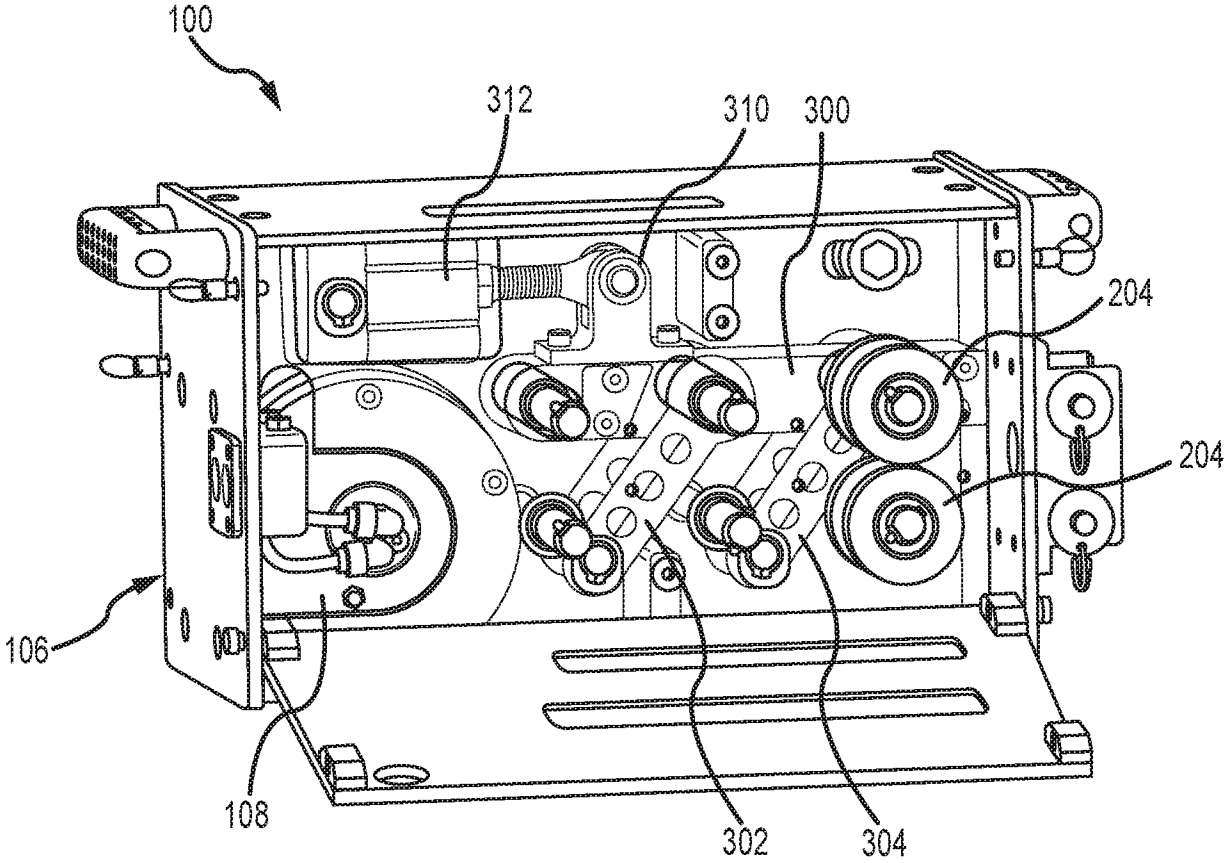
FIG. 9 is a perspective view as in FIG. 8 with the roller clamping structure in a hose drive position.

FIGS. 8 and 9 reveal that the axles 202 for the upper three roller assemblies 200 are mounted on a horizontal elongated metal support block 300 that can be moved along an arcuate path so as to remain parallel to the lower roller assemblies 200. This movement is constrained by two vertically oriented link pairs 302 and 304, one of each pair on opposite sides of the support block 300. These link pairs 302 and 304 are each fixed to rotate about horizontal pivot axles 306 and 308 within the central cavity in the housing 106. These pivot axles 306 and 308 are rotatably supported by walls 112 and 114. These pivot axles 306 and 308 are spaced below and to the right (forward of) of two of the lower wheel assembly axles 202. Note that the rollers for these lower drive wheel assemblies 202 have been removed in FIGS. 8 and 9 to facilitate this explanation.

The elongated block or chassis 300 is attached to a distal arm 310 of the piston of a pneumatic cylinder 312. The pneumatic cylinder 312 is free to rotate about a pivot point 314 that is fixed to a spacer block fastened between the inner and outer walls 112 and 114 within the mid section or central cavity of the housing 106. Since the lower ends of the link pairs 302 and 304 are fastened to pivot axles 306 and 308, when air pressure is removed from the pneumatic cylinder 312, an internal spring in the cylinder 312 tends to contract the arm 310. This causes the chassis or block 300 to remain parallel to the lower three roller assemblies 200 while it moves through a slight upward arc to the left to a position shown in FIG. 8, and thus raise the upper three roller assemblies 200 away from the lower three roller assemblies 200.

The location of pivot axles 306 and 308 relative to the positional location of the wheel assembly axles 202 along with the length of link pairs 302 and 304 define an arcuate path for the block 300 and in turn the upper roller assemblies 200. This arcuate path enables simultaneous achievement of two discrete machine functions. Function One is the accommodation and clamping of a lance hose 104 to facilitate feeding the lance hose in and out of the machine in a variety of conditions and use environments. Function two is maintaining belt tension sufficient to prevent belt/sprocket slippage through the full range of acceptable lance hose size accommodation. The machine 100 is designed to accommodate several lance hose diameters, for example, from preferably 3/2 up to 6/4 such that, as the elongated block or chassis 300 is moved along its arcuate path defined by the position and lengths of link pairs 302 and 304, the serpentine belt 320 remains in proper wrap engagement with the drive sprockets 322 without a need for manual adjustment of belt tension. As the center distance between lower and upper drive sprockets 322 is increased or decreased, the wrap engagement of the serpentine belt 320 with the drive sprockets 322 decreases or increases to offset the center distance change with regard to belt length. Because of this arcuate path, acceptable belt tension is maintained through the full range of block 300 travel in accommodating the full range of lance hose sizes.

When pneumatic pressure is applied to the cylinder 312, the distal arm 310 is extended, i.e. pushed to the right, pushing with it the chassis or block 300 through a clockwise arc while remaining parallel to the lower set of rollers 204 via links 302 and 304 so that the upper set of rollers 204 are each equally biased downward against the fixed lower set of rollers 204. This parallel configuration ensures that equal pressure is applied to and between each pair of rollers and thus equally to the flexible lances 104 held therebetween.

Furthermore, these parallel links 302 and 304 ensure that downward pressure exerted by the upper rollers 204 against the lower set of rollers 204 is equally distributed and adjustably greatly enhanced through use of the block 300. As extension air pressure in the cylinder 312 extends the distal arm 310 this pushes the block 300 downward against the lower set of rollers 204. This downward force supplements the frictional force generated by the drive rollers rotating against the flexible lance or lances 104 carried therebetween to drive them into or back out of the tubes being cleaned. This downward force is completely adjustable by the operator. This force applied may be varied by the operator and varies in accordance with the pressure applied to the cylinder 312. The pressure may be released allowing only the frictional force between the driven rollers and the flexible lances to be applied, so as to gently urge the flexible lances 104 forward or backward as desired in order to optimally handle anomalies or obstructions encountered during use. This adjustable drive roller pressure feature of the apparatus 100 in accordance with the present disclosure in conjunction with its compact size greatly enhances the utility of the apparatus 100.

Figure 7:
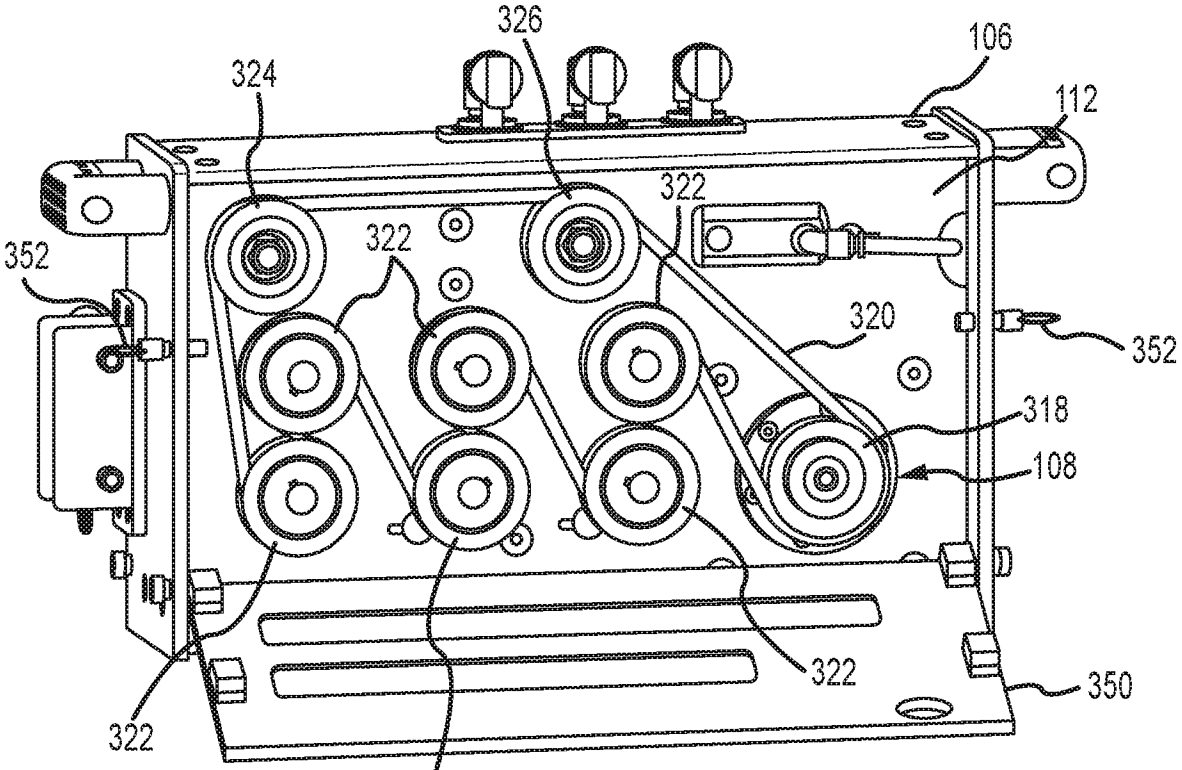
FIG. 7 is a separate enlarged left side perspective view of the drive apparatus shown in FIG. 5 with the inner, or left side door open.

The inner side section of the housing 106 is shown with the inner side door open in FIG. 7. Here a drive sprocket 318 of the air drive motor 108 is visible. The air drive motor 108, housed within the central cavity between inner and outer walls 112 and 114, rotates a serpentine belt 320 that wraps around and engages a drive sprocket 322 on each axle 202. The serpentine belt 320 is sequentially threaded over a drive sprocket 318 keyed to the drive shaft of the motor 108 and around each of the drive sprockets 322 in sequence and around idler sprockets 324 and 326.

Each of the inner and outer walls 112 and 114 has three slots 116 through which the upper roller axles 202 carried by the elongated block 300 project. These slots 116 permit the block 300 to move the upper rollers 204 during transitions between the released position shown in FIG. 8 and the engaged position shown in FIG. 9. Two of these slots 116 are visible in FIG. 8 as the outer wall 114 is shown as being transparent so as to reveal the block 300 and link components 302 and 304 within the mid section of the housing 106.

Adjacent each of the pairs of roller assemblies 200 are lance guides 330 fastened to the outer wall 114. These lance guides 330 facilitate aligning the lance hoses 104 as they are inserted through the pairs of roller assemblies 200 in the outer section of the housing 106. A pair of guide sleeves 322 provides the same function prior to and during flexible lance entry into the array of roller assemblies 200. These guides 330 are best shown in FIG. 6.

Figure 6:
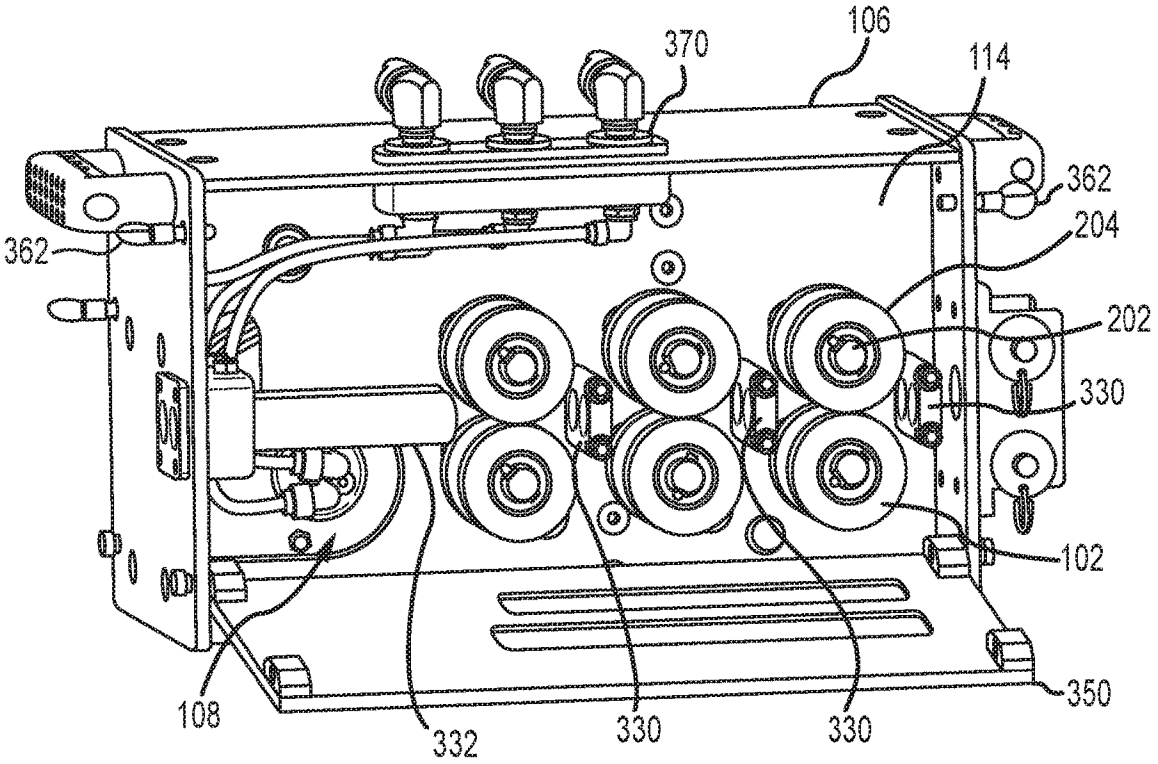
FIG. 6 is a separate enlarged right side perspective view of the drive apparatus shown in FIG. 5.

In the separate side views of FIGS. 6 and 7, the compact and easily maintainable nature of the apparatus 100 becomes apparent. If a user needs to change the rollers to accommodate a different flexible lance size, the user need only pull spring loaded pins 352 to open and lower the outer side door 350 in order to provide complete access to the outer section of the housing 106. Similarly, if a user needs to perform maintenance of the drive portions of the apparatus, the user need only open the inner door panel 360 by withdrawing spring loaded pins 362 and lower the panel 360 to provide access to the inner section of the housing 106.

If a user needs to perform maintenance on the pneumatic manifold 370, complete access is provided via the outer door 350. Similarly, if adjustment of the serpentine belt tension is needed, a user can adjust the belt tension by adjusting position of idler pulleys 324 and 326 from the inner section of the housing 106 through inner door 360.

Many changes may be made to the apparatus, which will become apparent to a reader of this disclosure. In some embodiments of the roller assemblies 200 the roller 204 may be provided with a straight cylindrical outer shape without grooves as currently shown. The rollers 204 without peripheral grooves may provide long roller life by elimination of stress points at the corners of the illustrated roller grooves, and the rollers 204 may be made of a resilient material to conform to the outer surface shape of the lance hoses 104. The housing 106 may be made other than a rectangular box shape as shown. To accommodate a different number of driven roller assemblies, different positioning of the pneumatic cylinder 312, or different arrangement of the support block 300 and hence linkage members 302 and 304. Furthermore, the relative positioning of fixed and movable lower and upper roller sets 204 may be reversed or the offsets between the linkage members 302 and 304 changed.

If a stronger drive force is needed, additional sets of driven roller pairs 200 than three pairs as shown may be provided to drive the flexible lances 104. The apparatus 100 is compact and weights about 45 pounds and thus may easily be easily handled via handles 121 and fastened via clevis pins 115 to a guide module 117 which is in turn supported by a lightweight positioner frame 119 in registry adjacent a tube sheet 110 as is shown in FIG. 5.

In alternative embodiments, electrical or hydraulic actuators and motors may be used in place of the pneumatic motors shown and described. Therefor, all such changes, alternatives and equivalents in accordance with the features and benefits described herein, are within the scope of the present disclosure. Such changes and alternatives may be introduced without departing from the spirit and broad scope of this disclosure as defined by the claims below and their equivalents.

What is claimed is:

1. A quick release drive roller and axle apparatus for use in a flexible high pressure fluid lance drive, the apparatus comprising:

a cylindrical drive axle having an axially extending closed slot adjacent a distal end of the axle, wherein the slot has opposing ends and is closed at each end of the slot;

a ball nosed spring plunger disposed in a cross bore spaced from the closed slot through the distal end of the axle;

a spline disposed in the closed slot; and a drive roller having a central bore and an axial slot along the central bore, wherein when the drive roller is assembled onto the drive axle, the spline engages the axial slot along the central bore and the ball of the ball nosed spring plunger extends outward from the cross bore radially away from the closed slot and engages the drive roller to retain the drive roller on the axle.

2. A flexible lance drive apparatus comprising:

a housing having a front wall and a rear wall, an outer section, an inner section and a mid section defined between a pair of spaced outer and inner walls perpendicular to and extending between the front and rear walls;

a drive motor disposed in the housing operably engaging a plurality of drive axles extending across the pair of spaced outer and inner walls arranged in an array of parallel axle pairs in the housing, each axle supporting a drive roller adapted to engage one or more flexible lances positioned in an axial plane through the housing perpendicular to the drive axles;

wherein at least one of the drive axles has an axially extending closed slot adjacent the distal end of the at least one axle, wherein the slot has opposing ends and is closed at each end of the slot, a ball nosed spring plunger disposed in a cross bore spaced from the closed slot through the distal end of the at least one axle, a spline disposed in the closed slot, and a drive roller releasably carried on the at least one axle covering the axial slot and engaging the spline in the axial slot and a ball of the ball nosed spring plunger extends radially outward from the cross bore engaging the drive roller to releasably retain the drive roller on the axle.

3. A flexible lance drive apparatus comprising:

a generally rectangular housing having a front wall and a rear wall, an outer section, an inner section and a mid section defined between a pair of spaced outer and inner walls perpendicular to and extending between the front and rear walls;

an array of upper and lower drive rollers in the outer section each rotatably supported by an axle shaft passing through the spaced outer and inner walls;

a drive sprocket fastened to each of the shafts in the inner section of the housing;

wherein each lower drive roller shaft is rotatably supported in a fixed position in each of the outer and inner walls and supported by both the outer and inner walls; and each of the upper drive roller axle shafts is parallel to the lower drive roller axle shafts and is rotatably supported by a block carried in the mid section of the housing by parallel pivoting link members each extending from the block parallel to one of the outer and inner walls and wherein each pivoting link member is fastened to one of the outer and inner walls adjacent one of the lower drive roller shafts.

4. The apparatus according to claim 3 wherein the array comprises three or more pairs of upper and lower drive rollers each configured to receive and hold therebetween a plurality of flexible lances.

5. The apparatus according to claim 3 wherein the upper shafts are each disposed in slots in the inner and outer walls and the block is pivotally supported by a pneumatic cylinder fastened to the housing.

6. The apparatus according to claim 3 further comprising a serpentine belt in the inner section of the housing connected between each of the drive sprockets and the drive motor operable to synchronously rotate the rollers.

7. The apparatus according to claim 3 further comprising at least one of the drive roller axle shafts having an axially extending closed slot adjacent a distal end of the axle;

a ball nosed spring plunger disposed in a cross bore through the distal end of the axle shaft spaced from the closed slot;

a spline disposed in the closed slot; and a drive roller having a central bore and an axial slot along the bore, wherein when the drive roller is assembled onto the at least one axle, the spline engages the axial slot along the central bore and a ball of the ball nosed spring plunger extends radially outward from the cross bore and engages the drive roller to retain the drive roller on the at least one axle.

8. The apparatus according to claim 7 further comprising each of the drive axle shafts having an axially extending closed slot adjacent the distal end of the axle shaft, a ball nosed spring plunger disposed in a cross bore through the distal end of the axle shaft spaced from the closed slot, a spline disposed in the closed slot, a drive roller releasably carried on the drive axle shaft and wherein the spline engages the axial slot along the central bore and a ball of the ball nosed spring plunger extends radially outward from the cross bore to releasably retain the drive roller on the axle shaft.

9. A flexible lance drive apparatus comprising:

a generally rectangular housing having a front wall and a rear wall, an outer section, an inner section and a mid section defined between a pair of spaced parallel outer and inner walls perpendicular to and extending between the front wall and the rear wall;

an array of upper and lower drive roller pairs in the outer section each rotatably supported by an axle shaft passing through the spaced outer and inner walls;

a drive sprocket fastened to each of the axle shafts in the inner section of the housing and connected to a drive motor via a serpentine belt;

wherein each lower drive roller axle shaft is rotatably supported in a fixed position in each of the outer and inner walls; and each of the upper drive roller axle shafts is rotatably supported by a block carried in the mid section of the housing by at least two parallel pivoting link members each extending from the block parallel to one of the outer and inner walls in the mid section and wherein each pivoting link member is fastened to one of the outer and inner walls adjacent one of the lower drive roller axle shafts.

10. The apparatus according to claim 9 wherein the upper shafts are each disposed in slots in the inner and outer walls and rotatably fastened to the block pivotally supported by a pneumatic cylinder fastened to the housing.

11. The apparatus according to claim 9 further comprising at least two pairs of pivoting link members connecting the block to the inner and outer walls adjacent the lower drive roller shafts.

12. The apparatus according to claim 9 further comprising at least one idler wheel contacting the serpentine belt for maintaining tension on the serpentine belt.

13. The apparatus according to claim 9 further comprising at least one of the drive roller axle shafts having an axially extending closed slot adjacent a distal end of the axle shaft;

a ball nosed spring plunger disposed in a cross bore through the distal end of the axle shaft;

a spline disposed in the closed slot; and a drive roller having a central bore and an axial slot along the central bore, wherein when the drive roller is assembled onto the drive axle shaft, the spline engages the axial slot along the central bore and a ball of the ball nosed spring plunger extends radially outward from the cross bore engaging the drive roller to retain the drive roller on the axle shaft.

14. The apparatus according to claim 9 wherein at least one of the drive axles has an axially extending closed slot adjacent the distal end of the at least one drive axle, a ball nosed spring plunger disposed in a cross bore through the distal end of the at least one drive axle, a spline disposed in the closed slot, and a drive roller releasably carried on the at least one drive axle and wherein the spline engages an axial slot along a central bore through the drive roller and a ball of the ball nosed spring plunger extends radially outward from the cross bore to releasably retain the drive roller on the at least one drive axle.

* * * * *